United States Patent [19]

Mirabile

[11] Patent Number: 4,572,230

[45] Date of Patent: Feb. 25, 1986

[54] BEVERAGE TUBE CLEANER

[76] Inventor: Paul J. Mirabile, 100 Sparango La., Plymouth Meeting, Pa. 19462

[21] Appl. No.: 656,970

[22] Filed: Oct. 2, 1984

Related U.S. Application Data

[63] Continuation-in-part of Ser. No. 506,859, Jun. 22, 1983, Pat. No. 4,527,585.

[51] Int. Cl.[4] ..... B08B 3/04; B08B 9/06

[52] U.S. Cl. ..... 137/240; 134/58 R; 134/166 C; 134/169 C; 137/565; 137/624.18; 137/322; 222/148; 222/400.7

[58] Field of Search ..... 137/238, 240, 322, 565, 137/624.18; 134/58 R, 166 C, 169 R, 169 C; 222/148, 400.7

[56] References Cited

U.S. PATENT DOCUMENTS

| | | | |
|---|---|---|---|
| 932,284 | 8/1909 | Jones | 137/238 |
| 1,993,371 | 3/1935 | Jones | 134/169 |
| 2,023,854 | 12/1935 | Petricone | 134/169 |
| 2,078,740 | 4/1937 | Stahl | 134/169 |
| 2,092,257 | 9/1937 | Lewis | 222/148 |
| 2,178,559 | 11/1939 | Cohen et al. | 137/240 |
| 2,458,230 | 12/1949 | Warcup | 222/148 |
| 2,645,379 | 7/1953 | Audia | 222/148 |
| 2,906,435 | 9/1959 | Nichols | 222/148 |
| 2,939,466 | 6/1960 | Hill | 134/169 |
| 3,025,863 | 3/1962 | Eberle | 134/169 |
| 3,120,326 | 2/1964 | Hedeman | 222/148 |
| 3,278,961 | 10/1966 | Svensson | 134/169 |
| 3,441,034 | 4/1969 | Burks | 134/169 |
| 3,498,502 | 3/1970 | Breitenstein et al. | 222/148 |
| 3,572,367 | 3/1971 | Reich | 222/148 |
| 3,833,417 | 9/1974 | Griparis | 134/169 |
| 3,916,923 | 11/1975 | Branton | 134/169 |
| 3,945,411 | 3/1976 | Skoli et al. | 134/169 |
| 4,159,102 | 6/1979 | Fallon et al. | 137/322 |
| 4,168,677 | 9/1979 | Brown | 134/169 |

*Primary Examiner*—G. L. Walton

*Attorney, Agent, or Firm*—Steele, Gould & Fried

[57] ABSTRACT

A beverage tube cleaner especially applicable as a permanent installation for cleaning draft beer distribution systems includes automatically controlled valves and a centrifugal pump for sequentially draining, cleaning, rinsing and draining conduits along the full length from their pressurized beverage sources to their spigots. The standardized fittings normally connecting the conduits to the kegs or other beverage sources are removed from the sources and connected end-to-end in pairs via unions mounted directly on the cleaner casing. Water pressure and pump vacuum force the cleaning and rinsing solutions through the conduits and the connecting unions, and under control of a sequence controller, treat the entire length of each conduit.

17 Claims, 5 Drawing Figures

| STEP | WATER | CLEANER | INPUT | OUTPUT |
|---|---|---|---|---|
| 1 | | | | X |
| 2 | | X | X | |
| 3 | X | | X | |
| 4 | | | | X |
| 5 | | X | X | |
| 6 | X | | X | |
| 7 | | | | X |

BEVERAGE TUBE CLEANER

CROSS REFERENCE TO RELATED APPLICATION

This application is a Continuation-In-Part of prior application Ser. No. 506,859, filed June 22, 1983, now U.S. Pat. No. 4,527,585.

BACKGROUND OF THE INVENTION

1. Field of the Invention

This invention relates to conduit cleaning systems, and especially to a permanently-installed electric-pump and water-pressure powered beer coil and conduit cleaner.

2. Description of the Prior Art

The usual beverage delivery system comprises a source of the beverage, for example a keg of draft beer, a source of pressure, for example a container of compressed carbon dioxide, and a conduit to carry the beverage to a discharge point having a manually activated spigot. In order to discharge a beverage at an appropriate temperature for drinking, the beverage source may be stored in a temperature-controlled area, or the beverage-carrying tube may be passed through such an area, thereby bringing the beverage to desired temperature. In taverns, the system frequently takes the form of a refrigerated room for storage of kegs, and a system of permanent tubes or conduits for connecting the kegs to distribution spigots at a customer service area.

Draft beer is an upasteurized food material which is surprisingly sensitive to rough handling. Discontinuities in pressure and temperature encountered in a conduit by the beer may cause unacceptable foaming, and may adversely affect the taste and aroma. Foreign material must also be strictly avoided. During brewing, the brewmaster, of course, has various means of controlling the chemical and physical environment of the processed materials. In order to ensure correct taste, aroma and appearance, similar care must be taken with the beverage delivery system.

Care must be taken to maintain the optimum taste, aroma and appearance; and moreover, safe and correct sanitation requires that the beverage delivery system be as clean as possible. Under some circumstances, the organic materials present in the beer mmay chemically react or decompose. So-called beer stones may precipitate out in the conduit system. Microbial action can degrade the beer. Therefore, for many reasons, the conduit must be kept scrupulously clean.

A frequently encountered beverage delivery system relying on heat exchanged delivery employs a heat transfer section along the beverage delivery conduit, which heat transfer section is located in a refrigerated area. The kegs may or may not also be kept refrigerated. Relatively warmer beer from a keg is conveyed along a conduit to the heat transfer passage, immediately preceding the spigot. It will be appreciated that the heat transfer section, which normally takes the form of a helical coil of metal tubing, is both a physical discontinuity and a temperature discontinuity encountered by the beverage being coveyed through the conduit.

Beverage delivery systems employing heat transfer coils are more susceptible to accumulations of unwanted materials and are less easily cleaned than are simple conduit sections of systems in which the kegs themselves are stored in a temperature controlled area. Nevertheless, both types of beverage delivery systems must be regularly cleaned both to produce a good beverage and to comply with relevant health codes.

Conduits may be cleaned by flushing with cleaning fluid and water. In early conduit cleaning systems water pressure was used to fill the tubes with water, and then a manually reciprocating pump device was operated to surge and agitate the water together with a cleaning solution, thereby dissolving and/or loosening foreign materials. The conduits are then opened at the keg and gravity drained. U.S. Pat. Nos. 1,993,371 to Jones; 2,023,854 to Petricone; 2,078,740 to Stahl; and No. 2,092,257 to Lewis involve such devices.

In order to function, pump-driven agitation devices of employ either a circular path around which the fluid is agitated, or a substantial length of tube must be involved such that a surging flow can be accommodated at least in a section of the tube. The aforesaid patents to Jones, Petricone and Lewis teach cleaning a pair of adjacent beverage delivery tubes at the same time by connecting them in a loop. The beverage tubes are removed from the kegs and manually connnected together at their keg ends; and, the pump is moved in and connected between the distribution spigots at opposite ends of the two tubes being cleaned. A third connection to a source of water may be added whereby the flushing system is initially charged with water, after which the user manually or electrically operates the pump to force the water around the circular passage created by the connection of conduits at the keg end and through the pump. These multiple connections present a danger of spillage which is a serious problem in the customer service area as well as in the refrigerated storage area. Such connections likewise do not lend themselves to quick or convenient operation.

The cleaning device of Stahl is somewhat more simple in that the manually-operated pump functions on a first stroke to draw cleaning fluid into the pump chamber, and on a second stroke to discharge the pump fluid into the beverage coil conduit. The fluid is alternately surged into the beverage coil and drawn back into the pump, finally being discharged into a reservoir. The spigot may be opened during cleaning. Should the device be applied to a closed conduit, a substantial conduit length may be necessary before the surging on which this system depends will occur. Moreover, in such system, for the most part, the surging occurs only in a portion of the conduit close to the pump.

U.S. Pat. Nos. 2,092,257 to Lewis; 2,906,435 to Nichols; and 3,441,034 to Burks employ pumps in an effort to provide the necessary surging of fluid to clean the tubes. Similarly, U.S. Pat. Nos. 2,458,230, Warcup and 2,645,379 to Audia appear to rely upon fluid pressure and/or air pressure to achieve cleaning fluid motion. In Lewis, fluid motion is assisted by connecting neighboring keg lead lines together, forming a loop. A number of the subsequent devices include manually-operated valves adjacent the keg or the spigot.

Typically, the prior art coil cleaning systems are add-on devices which are temporarily installed by removing fitting from kegs and attaching cleaning system tubes to the conduits at the kegs and/or spigots and/or at a water supply. It has been proposed in a previous application by the present applicant, copending herewith, to adapt a system such that a cleaning system could be a permanently-installed part of the conduit plumbing fixtures of a tavern or like establishment. Basically, a system of valves and pumps is disposed to clean a system of closed conduits (i.e., with closed spigots) downstream in the flow path from a permanent cleaning apparatus. A separate provision was provided for cleaning the so-called "lead beverage tubes," that is, the tubes between the kegs and the permanently-installed cleaning apparatus located near the keg end of the conduits.

Current commercial beverage distribution systems rely upon standardized fittings for connection of compressed gas such as $CO_2$ or compressed air, and to convey the beverage along the conduit system. In permanent-plumbing installations, the lead beverage tube is a flexible tube adapted to connect a keg at any location within a certain span, to the conduit system. A standardized fitting is used in the Tri Tap dispensing system of Draft Systems, Inc, 19791 Bahama Street, Northridge, Calif. 91324 (213-882-8012). Such fittings may be connected to kegs to include not only a supply for the beverage conduit and a supply of compressed gas, but also to isolate the conduit and/or key upon disconnection. A system of integral valves is included such that upon removing the fitting from the keg, appropriate valve closures are initiated to avoid the possible contamination of the beverage, loss of compressed gas and the like.

Efforts have been made to adapt the Tri Tap system to accomplish cleaning of multiple beverage tubes by fittings adapted to connect the tubes in a single length. Basically, a plumbing union having an axial rod for operating the valves in the standardized keg fitting facilitates interconnection of two such keg fittings and opens their internal valves to flow.

The present invention derives the benefits of a permanently-installed beverage cleaning system, without the necessity of a separate cleaning apparatus for the lead beverage tubes. This is accomplished by adapting the permanently-installed system with permanently-installed unions of the aforesaid connection variety, such that the entire length of beverage tube conduit can be cleaned right on the permanent apparatus, using a automatic sequence-controlling device to control operation of valves and a pump. The kegs are disconnected and the conduits isolated by removing the standard fittings from the kegs for attachment to one another. Upon operation of the cleaning system, the contents of the conduits are cleaned and drained under control.

SUMMARY OF THE INVENTION

It is an object of the invention to achieve the maximum convenience and effectiveness in cleaning a beverage delivery system, at minimum expense.

It is also an object of the invention to optimally adapt a permanently-installed conduit system of a walk-in keg storage cooler to an electrically controlled conduit cleaner.

It is another object of the invention to provide a beverage conduit cleaner which is self-contained and may be conveniently inserted immediately between keg connections and conventional beverage delivery systems.

It is yet another object of the invention to provide a modular beverage tube cleaner unit adaptable to an indefinite number of conduits.

It is still another object of the invention to minimize the number of valves and parts in an effective and convenient conduit cleaning device.

These and other objects are accomplished by a beverage tube cleaner especially applicable as a permanent installation for distribution systems including automatically-controlled valves and a centrifugal pump for sequentially draining, cleaning and rinsing conduits from pressurized beverage sources to spigots. The standardized fittings normally connecting the conduits to the kegs or other form of beverage source are removed from the sources and connected in pairs by means of unions conveniently mounted on the cleaner casing. The unions carry the cleaning and rinsing solution which, under control of a sequence controller, treat the entire length of each conduit.

BRIEF DESCRIPTION OF THE DRAWINGS

There are shown in the drawings the embodiments which are presently preferred. It should be understood, however, that the invention is not limited to the precise arrangements and instrumentalities shown in the drawings wherein.

DETAILED DESCRIPTION OF THE PREFERRED EMBODIMENTS

Figure 1:
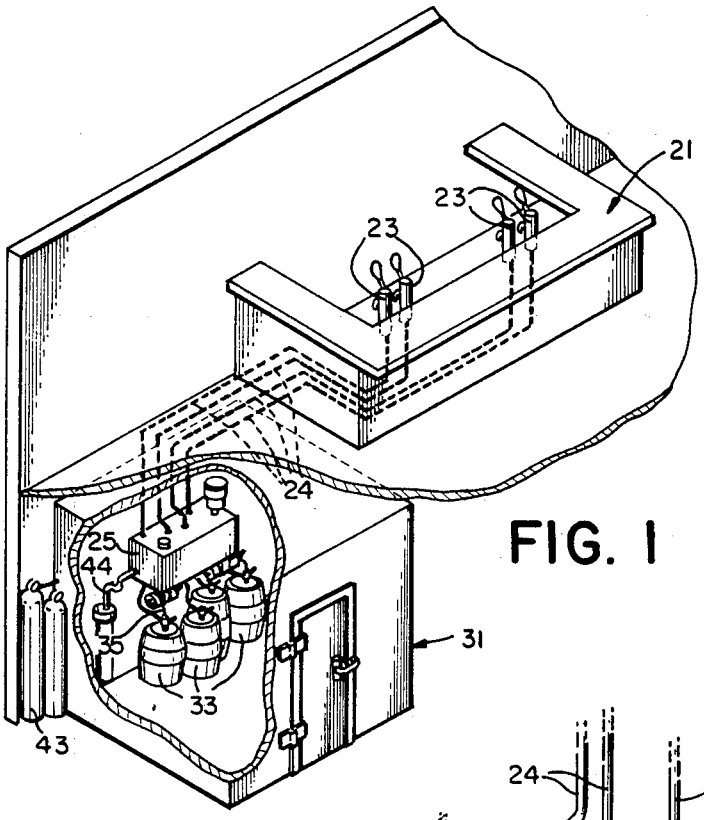
FIG. 1 is a perspective cutaway view of a two-story tavern and keg storage arrangement, the kegs being connected to a conduit cleaner according to the invention.

The overall environment of the invention is shown in FIG. 1. In order to convey a cold beverage to a distribution point, a cold storage area in which supplies of the beverage are stored in connected via permanently-installed conduits 24 to the beverage distribution points. The walk-in refrigerator 31 of substantial size is located in another part of the building from tavern area 21, for example in the basement of the building. The beverage containers, e.g., beer kegs 33 are pressurized, for example by means of compressed gas supply 43. Under pressure, the liquid beverage carried by conduits 24 from kegs 33 is released into glasses, pitchers and the like at distribution spigots 23, by merely opening the spigots when needed. Tubes 24 may be $\frac{3}{8}$ inch inside-chamber stainless steel tubing. Flexible lengths 35 of tubing, known as "lead beverage tubes," terminate the conduits in quick release fittings 27 at the kegs. A flow rate of approximately one gallon per minute per beverage tube is considered to be adequate for most installations.

Tavern operators may desire to store kegs 33 in the same walk-in refrigerator 31 that is used to store other materials. In a restaurant, food may be stored in the refrigerator, or even if the establishment operates solely as a beverage supplier, packaged beverages may be stored in the same refrigerator. Any additional storage needs restrict the available space for kegs 33, which are unwieldy. Spills of beer in the refrigerator may effect the taste or smell of the materials stored there, or freeze on the floor, making access difficult. The danger of spills and problems of space is aggravated because efficiency of cooling requires that the internal dimensions of the walk-in refrigerator be as small as practicable for storing an adequate supply of kegs. The invention has therefore been adapted for maximum convenience and security against spillage.

In order to operate the conduit cleaning system according to the invention, the user is required to disconnect the lead beverage tubes 35 from the kegs or other beverage sources 33, and connect them in pairs in end-to-end relationship at the source end of the conduits. In other words, each pair of the beverage tubes is connected in a "U" configuration, the ends of which are at spigots 23 in the tavern area. The spigots are preferably left open for the cleaning operation, however, cleaning can often by accomplished even with the spigots closed, as explained more fully hereinafter.

Figure 2:
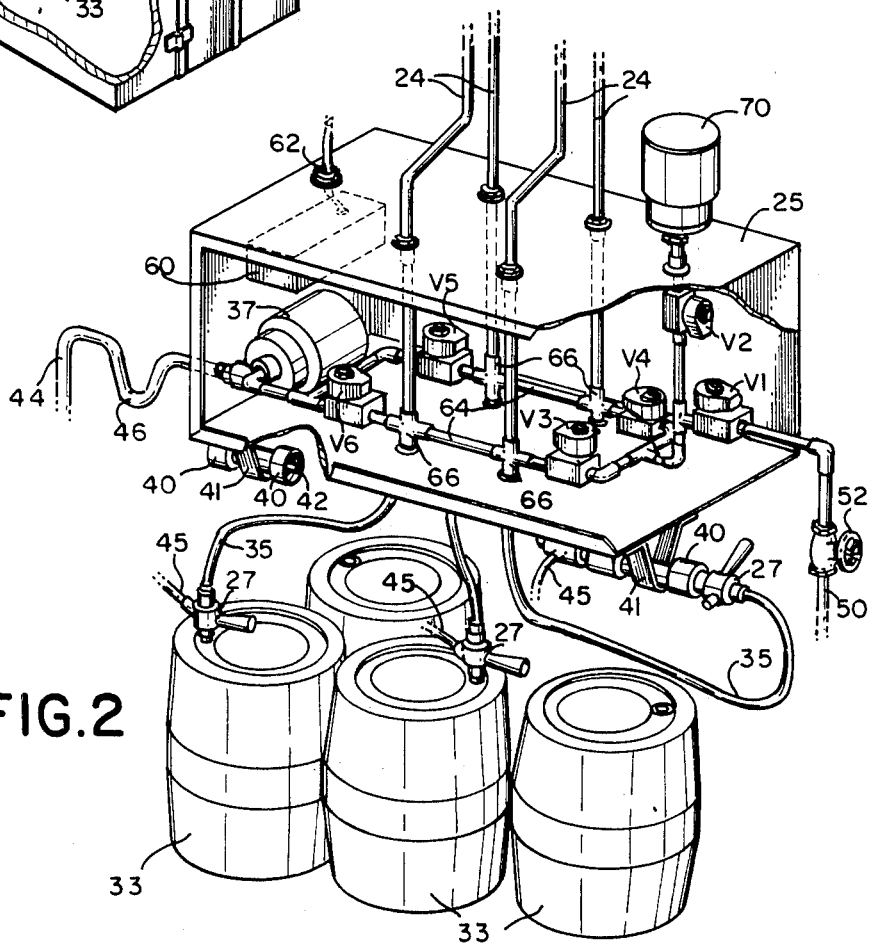
FIG. 2 is a partial perspective view of the cleaning device of the invention, including four beverage delivery tubes, the casing shown partly cut away.

The user disconnects the lead beverage tubes 35 from the kegs 33 using the standardized key-engaging mechanism 27, shown in FIG. 2. Such keg-engaging mechanisms are available from several sources, and one popular example is the Tri Tap available from Draft Systems, Inc., Northridge, Calif. The fitting 27 includes a manually-displaceable handle which provides a means of manually handling the device, and also operates the internal valves which close the fitting upon disconnection. The device is set up such that the lead beverage tube 35 remains sealed by a valve in tapping mechanism 27 which is opened by means of the pivotable handle after the tapping mechanism 27 is attached to the keg. Similarly, a gas line 45 also interacts with tapping head 27, which is configured such that the gas valve likewise remains closed until the handle is placed in the "operate" position. Gas line 45 connects the fitting to a gas pressure supply such as gas cylinders 43, shown in FIG. 1. Gas/liquid tapping mechanisms per se are known in the art.

According to the invention, a dual union 40 is mounted on a stand-off 41 on the front of casing 25 of the conduit-cleaning apparatus. In this manner, the union is conveniently accessible for receiving quick tapping fittings 27. Union 40 is arranged such that oppositely-facng female fittings, adapted to receive the tap fitting 27, are placed within the user's easy reach. Union fitting 40 are essentially a length of pipe having threads at either end for receiving tapping mechanisms 27. Moreover, in order to cause the tapping mechanisms to be opened to liquid flow but not to gas flow upon connection of the conduits, thereby allowing flow through the conduit mechanisms, an axial rod 42 is mounted to extend outwards in each end of union 40. Therefore, when fitting 27 is placed on union 40, pressure exterted by rod 42 causes the conduit to open to flow of liquid, as would occur upon connection of fitting 27 to one of the kegs 33. The gas-conveying conduit remains sealed.

Kegs 33 are disengaged simply by moving the lead beverage tube fittings 27 to the unions, and there accordingly is no possibility that cleaning fluid could leak into a keg. Although the user may find it convenient to change kegs at the time of cleaning, there is no requirement that the keg be empty before a lead beverage tube is disengaged for cleaning. Furthermore, unlike some prior art systems, there is no requirement of a concurrent operation to separately clean the lead beverage tubes. Instead, the lead beverage tubes 35 are cleaned together with the balance of the conduit by placing the entire conduit in the cleaning "U" configuration of conduit.

Figures 3, 4:
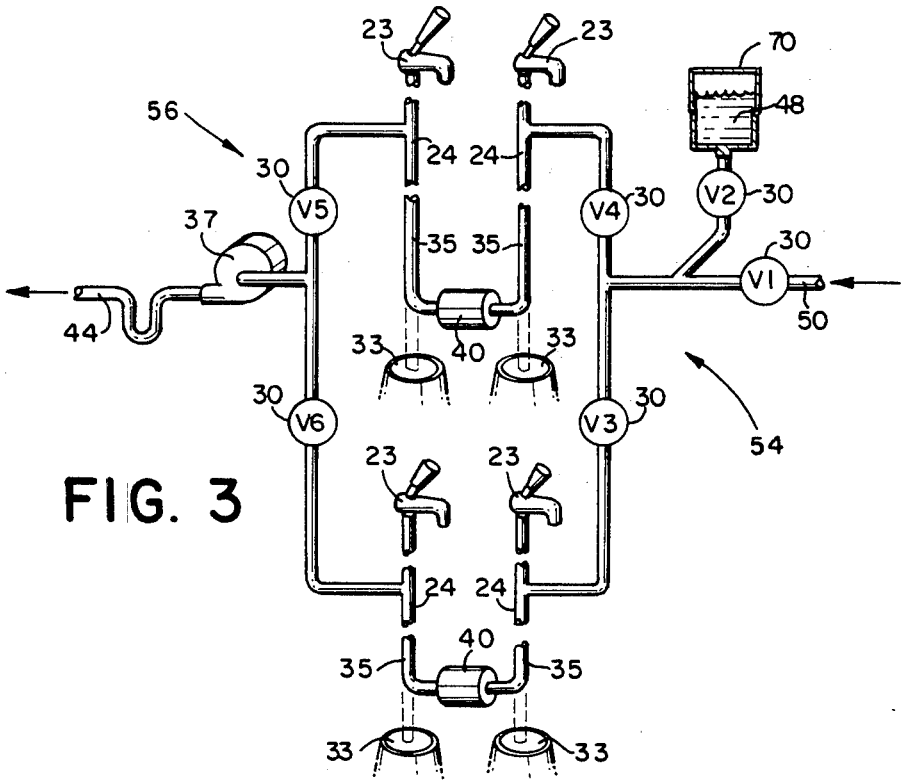
FIG. 3 is a schematic diagram of the pipe fitting interconnections of the invention, as adapted for two pairs of beverage delivery tubes.
FIG. 4 is a table showing an order of operations driven by the electric controller of the system; and, FIG. 5 is an elevation view of the system of the invention, adapted for daisy chaining of conduit cleaners under control of a single sequence controller.
Figure 5:
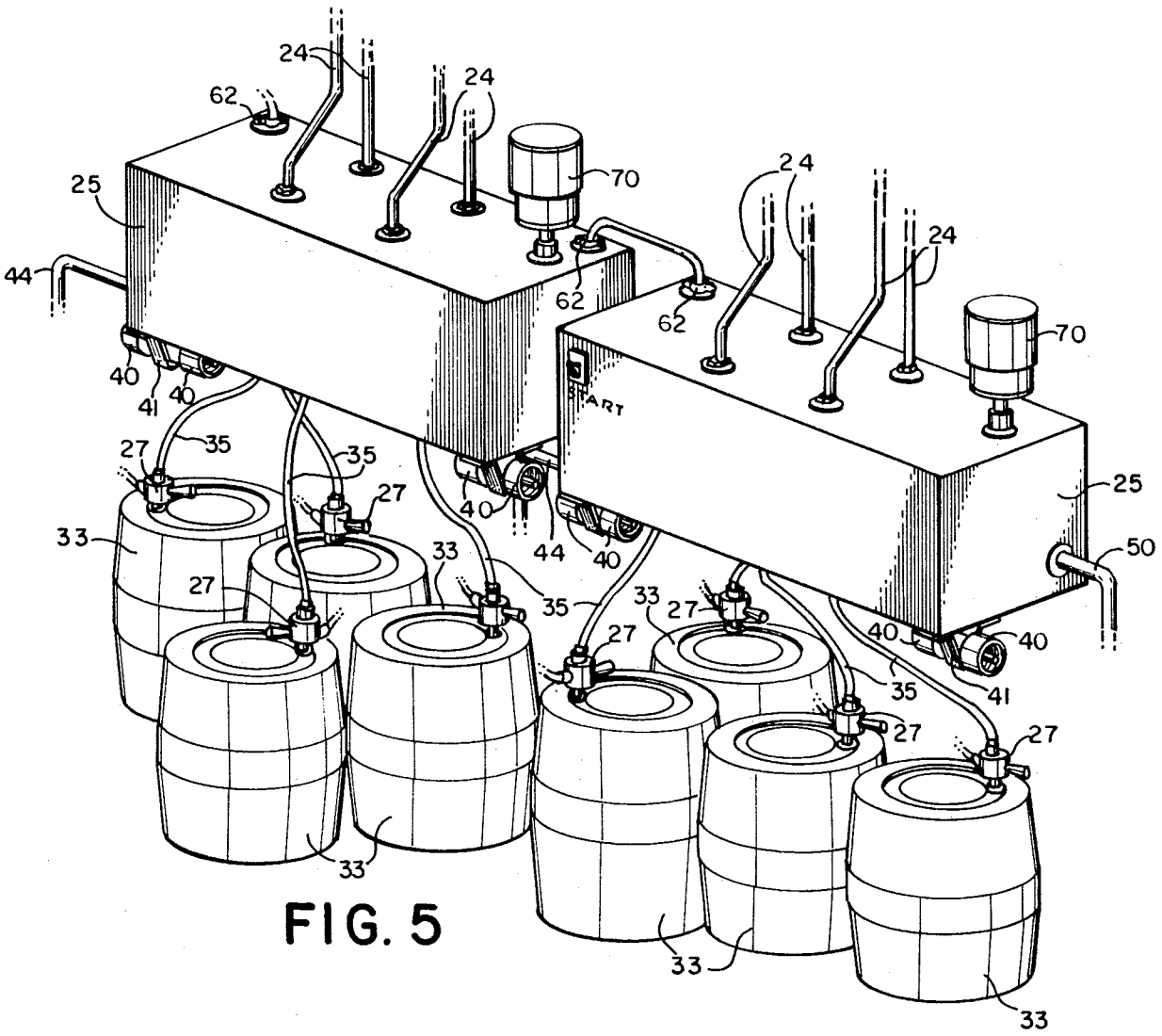

The physical packaging of the conduit cleaner is shown in FIG. 2. Reference can also be made to FIG. 3, which is a schematic diagram showing the interconnections of parts for purposes of explanation. The user having interconnected the beverage conduits in pairs by means of the structure provided on the conduit cleaner, the conduit cleaner is then operated under internal control such that predetermined combinations of automatically-controlled valves and a pump are operated for predetermined periods, to drain the conduits, alternately flush them with cleaning solution and rinse them, and drain them again. The device operates by controllably causing interconnection of the conduits, sequentially in pairs, with sources of cleaning solution, pressurized water, and a drain pump.

With reference to FIG. 3, the source end of each conduit 24, i.e., lead beverage tube 25, is disengaged from keg 33 and attached to union 40, whereby the conduits, in pairs, are connected in a "U" configuration terminating in spigots 23. Conduits 24 are connected to one another only through union 40. Each of the valves 30, namely electrically-operated solenoid valves designated in FIG. 3 by circles, are normally-closed.

Upon initiation, pump 37 is activated and output valves V5, V6 are opened. Preferably, spigots 23 are opened before initiating the system, whereby the quantity of beverage remaining in conduits 24 is drained from the system and emptied via drain 44. Valves V5, V6, which are electrically-operated normally-closed solenoid valves, are then closed.

As a next step, the input side valves V3, V4 are opened, as is the cleaning fluid-supply valve V2. The cleaning supply is fed by gravity, such that a predetermined quantity of cleaning fluid will fill tubes in the system up to the height of the cleaning fluid supply. The cleaning fluid will mix with water, and accordingly, is provided in supply 48 at some concentration greater than that at which it will be used in conduits 24. Some time is allowed for the cleaning fluid to fill the conduit to the predetermined height, after which valve V2 is closed and valve V1 is opened. Valve V1 permits pressurized water to run in from the input side 54 of the device, mixing with the cleaning fluid and forcing the cleaning fluid, together with water, to the end of conduits 24, namely to spigots 23. A sufficient delay is allowed to ensure the passage of cleaning fluid to the spigots, after which water supply valve V1 and input side valves V3, V4 are closed. The system is then drained, once again preferably using pump 37 and output side valves V5, V6. In the next step, the system is charged with clean water by opening valves V1, V3 and V4, after which those valves are closed and the output valves V5, V6 and pump 37 are operated to remove the rinse water. This sequence can be repeated a number of times if necessary.

It will be appreciated that, as shown in FIG. 3, the cleaning apparatus is divided into an input side 54 and an output side 56. The preferred emmbodiment includes two conduits 24 and spigots 23 on each of the input side 54 and output side 56, totalling 4 spigots. In smaller installations, having only two beverage distribution conduits, it is possible to use one junction 40, omitting valves V3–V6, and controlling the system using valves V1, V2 and pump 37. On the other hand, it is also possible to employ a system according to the invention with a virtually-unlimited number of further conduits, using further valves analogous to valves V3–V6, and connected to the supply junction of valves V1, V2 and to the drain pump 37 junction with valves V5, V6. Alternatively, additional units can be daisy-chained electrically on one controller.

A possible controlled sequence of operations is shown in FIG. 4. In this table, "water" designates supply of water, i.e., opening of valve V1; "cleaner" similarly designates valve V2; "input" designates opening the combination of the valves V3, V4; and, "output" designates opening the combination of valves V5, V6 and pump 37.

Pump 37 is preferably a centrifugal pump, which, unlike a piston pump, will allow a gravity flow of fluid toward the drain even when the pump is not operating. In this manner, a further refinement of the control sequence allows the cleaning fluid to drain slowly during the cleaning phase by operating pump 37 only after a delay period after cleaning is complete. Such a delay may also be used upon rinsing.

Should the system be operated with spigots 23 closed, it will be appreciated that the water pressure of cleaning or rinsing water will normally be rising in conduits 24 against the resistance of air trapped in conduits 24 approaching closed spigots 23. Although the water under pressure will travel nevertheless a substantial distance up conduits 24, the water will not run all the way to spigots 23 unless the distance is very short and the conduits very wide. Therefore, should the system be run with a spigots closed, some other provision must be made to assist the water is filling conduits 24.

Using the timing as controlled by the automatic controller operating the solenoid valves V1–V6 and pump 37, it is possible to more completely fill conduits 24 leaving spigots 23 closed, than would otherwise occur. This is done by operating pump 37 to develop a vacuum in conduits 24, after which is pressurized supply of water through valve V1 will substantially fully fill conduits 24. Furthermore, pump 37 operated to produce a vacuum has the additional beneficial effect of partially collapsing lead beverage tubes 35, removing cleaning solutions and/or water, even though the tubes 35 may have portions lower than the drain.

Whether the system can be practically operated with closed spigots will also depend to a certain extent on the dimensions of the overall system. Air pressure being approximately eqal to the weight of thirty feet of water, a system as shown in FIG. 1 having the drain 44 located substantially below spigots 23 will allow a rather complete vacuum to develop in conduits 24 whenever the pressure from gas 43 is removed, for example, when fittings 37 are removed from kegs 33 and the drain opened. Should the elevation of spigots 23 be thirty feet above drain 44, the system would operated adequately, developing a substantially complete vacuum in conduits 24, using pump 37 together with the pressure of the column of fluid.

The timing and operating sequence of the system is preferably controlled by means of automatic controller 60. Controller 60 may be, for example, a solid-state programmable matrix controller, having electrical outputs adequate to operate solenoid valves 30, for example 110 volts AC, which control the interconnections defined by valves V1 through V6. The solenoid valves are preferably standard 110 volt alternating current normally closed solenoid valves having a $\frac{3}{8}$ inch opening, as available from the Automatic Switch Company. The solid-state-type controller is a standard modern replacement for a relay ladder, which can also be used, and suitable models are available from such control system suppliers as Texas Instruments, Allen Bradley, and others. The system may also, of course, be executed in relays, as will be apparent, possibly including a timing means to drive a stepping switch to advance between operative conditions.

For system security, an activating device having means for preventing unauthorized initiation of a cleaning cycle is preferred. The activating device may be as simple as a key-operable switch, or as sophisticated as a digital code input device to the controller.

As shown in FIG. 2, the pipe-fitting connections for the valves and conduits are preferably based upon a more-or-less rectangular or circuitous interconnection of conduits 24 within casing 25. The rectanguar or like interconnection is not strictly required to achieve the flow interconnections illustrated in FIG. 3, but is preferred for purposes of structural integrity. Cross-shaped unions 66 are placed in each conduit 24 between lead beverage tube 35 and the remainder of the conduit. This accounts for two of the four parts of the cross-shaped union, a third opening providing the attachment to the respective valve V3–V6. The fourth opening is used for a structural interconnection by means of threaded rods 64 rather than a accomodate flow. Inasmuch as rods 64 are included only for a structural interconnection, and not to carry flow, the rod 64 may be a solid rod havig threaded ends. Alternatively, rod 64 an be a section of threaded pipe having an obstruction between the ends.

The outputs of the sequencer 60 are preferably wired not only to the valves V1–V6, but also to an auxiliary output connector 62, located at a convenient spot on the surface of casing 25. Connector 62 may be any convenient type adapted for carrying at least five conductors, i.e., sufficient conductors to define the five signals illustrated in FIG. 4, and a common. For installation having more than four beverage distribution lines, connector 62 is used to route the control signals from sequence controller 60, at operative voltages, to additional solenoid valves. Any further casings 25 having a connector for receiving the outputs of a first casing would require no sequence controller of their own, and could therefore be added to the basic device at minimum additional expense.

Cleaner supply 70, which is mounted above the level of casing 25 to facilitate gravity feed, may be a simple inverted cup-member having an opening for receiving a conduit leading to valve V2. Supply 70 must have a capacity sufficient to complete a cleaning operation, and preferably more than one cleaning operation. The container is located external to casing 25 for convenient filling.

Solenoid valves V1–V6 are conventionally provided with a high pressure supply side and a low pressure discharge side, and must be installed with these senses in mind. In order to prevent leakage, it is advisable to install valve V2 backwards to the flow directions of the other valves, that is, with the high pressure side facing toward the water supply 50 rather than towards the cleaner supply 70. This installation prevents leakage when valve V2 is closed and the supply 50 opened to flow.

If desired, a mechanical shut-off 52 can be provided for convenience to stop the water supply during installation and service. A trap 45 can be provided in the line of drain 44, as conventional in connection with drains.

The invention having been disclosed, a number of further variations will now become apparent to person skilled in the art. Reference should be made to the appended claims rather than the foregoing specification as indicating the true scope of the invention.

What is claimed is:

1. An apparatus for cleaning a beverage delivery system of a type having at least two conduits, each of the conduits carrying a beverage from a source container to an output, each of the conduits having a releasable standardized fitting having an operable fluid flow line, each standardized fitting being adapted to engage its respective source container, and an openable spigot at the output of each conduit, the apparatus comprising:

a supply for cleaning solution, a supply for pressurized water, and a drain;

valve means defining an input for alternatively and temporarily connecting the supply of cleaning solution and the supply of pressurized water, respectively, to a first of said conduits;

means definning an output for temporarily connecting a second of said conduits to the drain;

a casing means for housing the cleaning apparatus at least one union being a surface of the casing and operable to receive the standardized fittings for both said conduits by disconnecting said standardized fittings from the source containers and connecting said standardized fittings to said at least one union to cause said standardized fittings to open to liquid flow so that said conduits can be cleaned; and, a controller operable upon initiation to sequentially operate the input and the output to drain, clean and rinse the beverage delivery system.

2. The apparatus of claim 1, further comprising means for permanently-installing the apparatus in a beverage delivery system.

3. The apparatus of claim 2, wherein the valve means for alternately connecting the supply of cleaning solution and the supply of water to said first of the conduits are solenoid valves and the means for connecting the second of the conduits to the drain is a centrifugal pump.

4. The apparatus of claim 3, wherein the controller is a stepping switch.

5. The apparatus of claim 3, wherein the controller is programmable controller having outputs for each of the valves and for the pump.

6. The apparatus of claim 5, further comprising means for mounting the casing on a wall, the apparatus also having a first electrical connector on the casing, the outputs of the sequence control being wired to the electrical connector, and to the valves and pump.

7. The apparatus of claim 6, further comprising at least one further cleaning device and an additional casing having a second electrical connector adapted for connection to the first electrical connector, the additional casing having valves, a pump, a supply of cleaning solution, a supply of pressurized water and a drain, the further cleaning device being adapted for cleaning at least on additional pair of conduits under control of said controller.

8. The apparatus of claim 7, wherein the additional casing has a further electrical connector for connecting additional cleaning devices in a daisy-chain responsive to said controller.

9. The apparatus of claim 5, wherein the controller is programmable, and has means to receive input of data reflecting predetermined attributes of the conduit system, the controller operable to execute sequence and timing of the valve and pump operation as a function of said attribute.

10. The apparatus of claim 9, wherein the predetermined attributes include conduit inside diameter and length, and water pressure.

11. The apparatus of claim 3, further comprising connections to clean at least two additional conduits, the apparatus having solenoid valves for connecting each of a first pair of conduits and a second pair of conduits to the last input and output, respectively.

12. The apparatus of claim 11, wherein the beverage is draft beer and the standardized fittings are combination beverage/gas quick-removal connectors.

13. The apparatus of claim 12, wherein the union has means for opening valve means in the quick-removal connector, upon attachment thereof to the union.

14. The apparatus of claim 11, wherein the solenoid valves for the input and the output are attached to rigidly connect the first pair of conduits to one another, and the second pair of conduits to one another, respectively.

15. The apparatus of claim 14, further comprising at least one length of solid rod structurally attaching the first and second pairs of conduits together.

16. The apparatus of claim 15, having two lengths of threaded rod and attaching the first and second pairs of conduits, and wherein the pairs of conduits are symmetrically attached in a circuit, the input and output being opposite sides of the circuit and the lengths of threaded rod being on opposite sides of the circuit, the conduits each being connected to a valve and to a threaded rod at a threaded cross-shaped union.

17. The apparatus of claim 1, further comprising a security device controlling initiation of the controller, the security device preventing initiation by unauthorized persons.

* * * * *

UNITED STATES PATENT AND TRADEMARK OFFICE

CERTIFICATE OF CORRECTION

PATENT NO. : 4,572,230

DATED : February 25, 1986

INVENTOR(S) : Paul J. Mirabile

It is certified that error appears in the above-identified patent and that said Letters Patent is hereby corrected as shown below:

Column 1, Line 31 - "upasteurized" should be --unpasteurized--
Column 1, Line 46 - "mmay" should be --may--
Column 2, Line 9 - after "keg" insert --end--
Column 3, Line 20 - "key" should be --keg--
Column 4, Line 50 - "inside-chamber" should be --inside-diameter--
Column 5, Line 40 - "facng" should be --facing--
Column 6, Line 14 - "25" should be --35--
Column 6, Line 55 - "emmbodiment" should be --embodiment--
Column 7, Line 26 - "is" should be --in--
Column 7, Line 42 - "eqal" should be --equal--
Column 7, Line 49 - "operated" should be --operate--
Column 8, Line 11 - "rectanguar" should be --rectangular--
Column 8, Line 21 "a" should be --to--
Column 8, Line 23 "havig" should be --having--
Column 8, Line 24 - "an" should be --can--
Column 9, Line 11 - "alternatively" should be --alternately--
Column 9, Line 15 - "definning" should be --defining--
Column 9, Line 18 - after "being" insert --mounted on--

Signed and Sealed this

*Seventeenth* Day of *June 1986*

[SEAL]

*Attest:*

DONALD J. QUIGG

*Attesting Officer*

*Commissioner of Patents and Trademarks*